US011753290B2

(12) United States Patent
Peirsman et al.

(10) Patent No.: US 11,753,290 B2
(45) Date of Patent: Sep. 12, 2023

(54) ROVING BEVERAGE DISPENSING UNIT

(71) Applicant: Anheuser-Busch InBev S.A., Brussels (BE)

(72) Inventors: Daniel Peirsman, Brussels (BE); Johan Van Rompaey, Brussels (BE)

(73) Assignee: Anheuser-Busch InBev S.A., Brussels (BE)

( * ) Notice: Subject to any disclaimer, the term of this patent is extended or adjusted under 35 U.S.C. 154(b) by 0 days.

(21) Appl. No.: 17/186,545

(22) Filed: Feb. 26, 2021

(65) Prior Publication Data

US 2021/0354971 A1 Nov. 18, 2021

Related U.S. Application Data

(63) Continuation of application No. 14/240,319, filed as application No. PCT/EP2012/065539 on Aug. 8, 2012, now abandoned.

(30) Foreign Application Priority Data

Aug. 23, 2011 (EP) ..... 1178486

(51) Int. Cl.
*B67D 1/04* (2006.01)
*B67D 1/08* (2006.01)
*B67D 1/00* (2006.01)

(52) U.S. Cl.
CPC ..... *B67D 1/0412* (2013.01); *B67D 1/0004* (2013.01); *B67D 1/0406* (2013.01);
(Continued)

(58) Field of Classification Search
CPC ... B67D 1/0412; B67D 1/0004; B67D 1/0857
(Continued)

(56) References Cited

U.S. PATENT DOCUMENTS 3,096,000 A 7/1963 Staley
4,049,158 A 9/1977 Lo et al.
(Continued)

FOREIGN PATENT DOCUMENTS

EP 1 982 952 10/2008
EP 2 146 832 10/2008
(Continued)

*Primary Examiner* — Jeremy Carroll
(74) *Attorney, Agent, or Firm* — KLINTWORTH & ROZENBLAT IP LLP

(57) ABSTRACT

A roving beverage dispensing device has a beverage container in a cooled compartment and a flexible beverage dispensing line with connecting means coupling its inlet end to the container. A pressure line is releasably connected to the container and to a source of pressurized gas. An elongated tapping column fixed to the top of the compartment comprises elongated inner channel bringing in communication the interior of the compartment with tapping valve element suitable for receiving a portion of the outlet end of the dispensing line and for controlling the flow of liquid therethrough. The largest diameters of the dispensing line and the connecting means are sufficiently small so that the dispensing line can be introduced from the top end of the tapping column through the elongated channel into the compartment and connected to the container.

12 Claims, 2 Drawing Sheets

(52) U.S. Cl.
CPC ..... *B67D 1/0857* (2013.01); *B67D 1/0867* (2013.01); *B67D 1/0868* (2013.01); *B67D 2210/00133* (2013.01); *Y10T 29/49826* (2015.01)

(58) Field of Classification Search
USPC ..... 222/399
See application file for complete search history.

(56) References Cited

U.S. PATENT DOCUMENTS

| | | | | |
|---|---|---|---|---|
| 6,832,487 | B1 * | 12/2004 | Baker | B67D 1/0868 222/146.6 |
| 7,188,751 | B2 | 3/2007 | Van Der Klaauw et al. | |
| 8,066,156 | B2 | 11/2011 | Schiff et al. | |
| 8,225,092 | B2 | 7/2012 | Lal et al. | |
| 8,925,748 | B2 | 1/2015 | Van Hove et al. | |
| 9,604,835 | B2 | 3/2017 | Peirsman et al. | |
| 9,895,834 | B2 | 2/2018 | Van Hove et al. | |
| 9,944,453 | B2 | 4/2018 | Van Hove et al. | |
| 2004/0226967 | A1 * | 11/2004 | Van Der Klaauw | B67D 1/1405 222/146.6 |
| 2010/0282777 | A1 * | 11/2010 | Johnson | F25D 3/005 222/146.6 |

FOREIGN PATENT DOCUMENTS

| | | | | |
|---|---|---|---|---|
| EP | 2 148 770 | | 10/2008 | |
| EP | 2 148 771 | | 10/2008 | |
| EP | 2 152 494 | | 10/2008 | |
| EP | 2 514 711 | | 10/2012 | |
| JP | 06134149 | A | 5/1994 | |
| JP | H06134149 | A | 5/1994 | |
| WO | WO 01/92145 | | 12/2001 | |
| WO | WO 02/14210 | | 2/2002 | |
| WO | WO 2006/086932 | | 8/2006 | |
| WO | WO 2008/014210 | | 1/2008 | |
| WO | WO 2009/115928 | | 9/2009 | |
| WO | WO-2009115928 | A2 * | 9/2009 | B67D 1/04 |
| WO | WO 2009/142977 | | 11/2009 | |

* cited by examiner

ROVING BEVERAGE DISPENSING UNIT

TECHNICAL FIELD OF THE INVENTION

The present invention concerns roving beverage dispensing units for dispensing through a dispensing tap a beverage, typically a carbonated beverage like beer, by pressurizing the interior of the container containing said beverage.

BACKGROUND OF THE INVENTION

Draught beer is often preferred by consumers to bottled or canned beer. Draught beer is generally served at the counter of a public house out of a refrigerated keg provided with a fluid connection to a source of pressurized gas for driving the dispensing of the beer through a dispensing line fluidly connecting the keg to a dispensing tap, comprising a valve for controlling the flow out of said tap. In case of a temporary social event outside a public house, such as an outdoor event, wedding party, fair and the like, consumers would like to be offered draught beer for consumption. Furthermore, above a critical volume of consumption, serving bottled or canned beer would be too expensive and would generate too much waste. For these reasons, roving or mobile beverage dispensing units, offering the same quality of beer as a draught beer served at a public house, were developed and brought to the market. They are designed to accommodate a keg or container containing the beer, with a source of pressurized gas, such as a pressure gas bottle or a compressor. The containers used can be traditional metal kegs as used in public houses, possibly but not necessarily of smaller dimensions, or can include so called bag-in-containers as disclosed e.g., in EP2146832, EP2148770, EP2148771, EP2152494 and the like.

For example, US2004/0226967 proposes a roving dispensing unit comprising a cooling chamber suitable for accommodating and cooling a beer keg, a hollow column supported on said cooling chamber and a dispensing head comprising a tap valve. A source of pressurized gas, such as a compressor or a CO2 cartridge is provided for ensuring the necessary pressure for driving the beer flow out of the keg. A dispensing tube fluidly connects the keg to the tap valve. For reasons of hygiene, the dispensing tube is disposable and must be changed with each new keg. In one embodiment, the dispensing line is even permanently coupled to the keg to ensure that it will not be used a second time. Upon use, a new keg can be installed into the cooling chamber, and fluidly connected to a source of pressurized gas, generally located in the same chamber. The dispensing line is either permanently coupled to the keg or must be coupled thereto, before it is run through a channel defined in the hollow column until the dispensing tube outlet reaches the dispensing head of the column and is engaged into the tap valve mechanism. This "bottom-up" insertion system, wherein the dispensing tube is installed starting from the keg (located at the bottom) all the way up to the dispensing head (located at the top) requires that the dispensing line be provided with a shut-off valve to prevent the flow of beer out of the keg before the dispensing line is in place in the tap valve. It is clear that providing a shut-off valve to a disposable tube increases substantially the cost of use of the system. Furthermore, it can be quite cumbersome to drive up a flexible dispensing line through the hollow column which outlet to the cooling chamber is positioned at the back thereof and can easily be appreciated when looking e.g., at FIG. 2 of US2004/0226967.

In order to facilitate the engagement of the dispensing tube into the tap valve, a rather critical operation which is difficult to control from the interior of the cooling chamber, WO2009/115928 suggests to allow the opening of the dispensing head so that the dispensing tube outlet emerging from the opening at the top of the column can be handled from outside the cooling chamber and engaged more comfortably into the tap valve mechanism.

EP1982952 extends the idea of allowing the opening of the column to the entire length thereof. This solution greatly simplifies the "bottom-up" installation of the dispensing tube since it needs only be passed from the interior to the exterior of the cooling chamber through a short channel crossing the top board of the cooling chamber before it can be handled from outside the cooling chamber, instead of having to drive it from the inside of the cooling chamber all the way up to the dispensing head.

In spite of the various solutions proposed to simplify it, the "bottom-up" installation of a disposable dispensing tube remains cumbersome since the user must crouch and engage the head and shoulders into the cooling chamber to access the opening connecting the cooling chamber to the dispensing column inner channel, push up the flexible tube either all the way up to the dispensing head like in US2004/0226967, or only until the outlet of the tube reaches the opening in the column as in WO2009/115928 and in EP1982952, at which point it must be grabbed from the outside before it falls back all the way down into the cooling chamber. Since this operation must be repeated with each new keg installed into the cooling chamber, if the installation of the tube is too uncomfortable, users may become reluctant to use such roving beverage dispensing unit.

Soda dispensers such as disclosed in U.S. Pat. No. 6,832,487 cannot be compared with gas driven dispensers, as they usually make use of a pump for driving the liquid out of a bag. This solution permits to use simple and inexpensive connecting means for connecting a dispensing tube to the container containing the soda. Unfortunately, such solution is not implementable in gas driven dispensers as used. e.g., for dispensing beer which cannot flow through a pump which would create excessive foam, because the pressure such keg connector must support is much higher and continuous in time.

The present invention proposes a solution to greatly simplify the bringing into operational condition of a roving beverage dispensing unit loaded with a fresh keg.

SUMMARY OF THE INVENTION

The present invention is defined in the appended independent claims. Preferred embodiments are defined in the dependent claims. In particular, the present invention concerns a roving beverage dispensing device comprising:

(a) a beverage container containing a liquid beverage to be dispensed, (b) an at least partially flexible, beverage dispensing line, comprising an inlet end and an outlet end, the inlet end being provided with a dispensing line connector configured to connect said inlet end to said container to provide fluid communication between the container and the outlet end of the dispensing line, (c) a pressure line, the pressure line comprising an outlet releasably connectable to the container and providing fluid communication between an interior of the container and a source of pressurized gas, (d) a compartment for containing said container and comprising a refrigeration device, (e) an elongated tapping column comprising a fixed end fixed to the top surface of the compartment and comprising an elongated inner channel, said elongated inner channel having a smallest diameter (D1), and providing fluid communication between the interior of the compartment and a tapping valve element located at or adjacent to the top end of the elongated tapping column, said tapping valve element configured to receive a portion of the outlet end of the dispensing line and controls the flow of liquid therethrough, wherein the largest diameters of the dispensing line and the dispensing line connector are both smaller than a smallest diameter (D1) of the elongated inner channel and the tapping valve element such that the dispensing line and dispensing line connector can be introduced from the top end of the elongated tapping column, through the tapping valve element held in an open position, down through the channel and into the compartment where it can be connected to the container.

Instead of the cumbersome "bottom-up" operation required for the installation of a new dispensing tube in a roving beverage dispensing unit of the prior art, the present unit allows a "top-down" installation of the dispensing tube which is much more comfortable and quicker to complete than the former.

The gist of the invention is to provide the inlet of the disposable dispensing tube with connecting means having dimensions fitting in a channel of smallest diameter D1 such that it can be run through the inner channel of the tap column all the way down into the cooling chamber. This can easily be achieved by providing the dispensing line with connecting means selected from a bayonet, a threaded nut, a pin, preferably with a safety feature like a ring, and a resilient snap-fit.

Top-down insertion of the dispensing tube can be achieved in one of two ways. In one embodiment the inlet end of the dispensing tube including the connecting means is introduced from the tapping column top end, through the tapping valve element held in open position, all the way down to the compartment. In an alternative embodiment, the channel of the tapping column comprises an opening located upstream from the valve element, said opening allowing, on the one hand, the inlet end of the dispensing line, including the connecting means, to be driven through the channel down into the cooling compartment and, on the other hand, the outlet end of the dispensing tube to be introduced into the valve element.

The connection means at the dispensing line inlet can be coupled to the container directly through the closure thereof or, as is the case in conventional kegs also used in public houses, through a connecting device, fixed to the mouth of the container and suitable for bringing in fluid communication corresponding portions of the interior of the container with the dispensing line and pressure line, respectively. The source of pressurized gas is preferably located within the cooled compartment and comprises a pressurized gas bottle or a compressor, or comprises pressurized gas from the net. In an alternative embodiment, the pressurized gas can be stored within the container, e.g., adsorbed on a solid carrier.

In a preferred embodiment; the valve element at the top end of the column is a pinch valve and a portion of the outlet end (4*a*) of the dispensing line to be engaged in said pinch-valve is flexible. The liquid flow through the dispensing line can thus be controlled by pinching closed between the jaws of the pinch valve or releasing the flexible portion of the dispensing line to respectively stop or allow liquid to flow out of the dispensing line. This embodiment has the advantage to be simple, hygienic, and reliable, whilst probably the most economical.

In an alternative embodiment, the valve is made of two elements: a first valve element mounted on the column, and a second, co-element mounted at the outlet portion of the dispensing line and suitable, when engaged therein, for collaborating with the first valve element to control the flow of liquid through the dispensing line.

The roving beverage dispensing unit of the present invention is particularly suitable for dispensing beer, carbonated malt based beverages, such as non alcoholic beer, and cider.

The present invention also concerns a method for loading a new beverage container into a roving dispensing device as discussed supra, comprising the following steps:

(a) Providing a new container;

(b) engaging a portion of the inlet end into the valve element and introducing the inlet of the dispensing tube, including the connecting means, into the channel of the elongated tower and driving it down into the cooled compartment and;

(c) Connecting the connecting means of the dispensing line to the container.

(d) Connecting a source of pressurized gas with the interior of a new container via a pressure line;

The container, if not yet in the cooled compartment can be loaded therein and the cooled compartment closed. The beverage can be dispensed when the desired serving temperature of the beverage is reached.

As explained before, the inlet of the dispensing tube can be run top-down through the inner channel of the tapping tower in one of two ways. Either the inlet end of the dispensing tube, including the connecting means is introduced from the outlet of the channel of the tapping tower, engaged into the valve element, and driven all the way down into the compartment, where it is then connected to the container or, alternatively, it can be introduced into the inner channel through an opening located upstream from the valve element of the column and therefrom driven through the channel down into the cooled compartment. In the latter embodiment, the outlet end of the dispensing tube is introduced into the valve element of the column from upstream.

With the present system it is possible to couple the dispensing line to the container only after the outlet thereof is engaged in the tap valve of the tapping column. This allows to use much cheaper disposable dispensing tubes than in the prior art units, as they must necessarily be provided with a shut-off valve as disclosed in US2004/0226967, preventing any liquid from flowing out of the container upon connecting the dispensing line thereto, before the outlet end is engaged into the valve element of the column. Of course the tapping valve shall be closed prior to pressurizing and connecting the dispensing line to the container, otherwise the content thereof would start flowing out prematurely.

The present invention also concerns the combination of the following elements in a kit of parts:

(a) A beverage container containing a liquid beverage to be dispensed, (b) A first, at least partially flexible, beverage dispensing line, comprising an inlet end and an outlet end, the inlet end being provided with connecting means suitable for releasably connecting said inlet end to the container to bring the liquid contained in the container in fluid communication with the outlet end of the dispensing line, (c) a source of pressurized gas and a second, pressure line, for connecting the gas source into fluid communication with the interior of the container, (d) A cooled compartment comprising refrigerating means and suitable for containing said container and, if required, said source of pressurized gas, and provided fixed on a top surface thereof with;

(e) An elongated tapping column (1) comprising an elongated inner channel (2) having a smallest diameter, D1, and bringing in fluid communication the interior of the compartment with a tapping valve element (3) located at the opposite top end of the elongated tapping column, said tapping valve element being suitable for receiving a portion of the outlet end (4*a*) of the dispensing line and for controlling the flow of liquid therethrough, wherein the diameters of the dispensing line and the connecting means are both smaller than the elongated channel smallest diameter, D1, so that the dispensing line can be introduced from a point at or adjacent the top end of the tapping column down through the channel and into the compartment where it can be connected to the container.

BRIEF DESCRIPTION OF THE FIGURES

For a fuller understanding of the nature of the present invention, reference is made to the following detailed description taken in conjunction with the accompanying drawings in which.

DETAILED DESCRIPTION OF THE INVENTION

Figure 1:
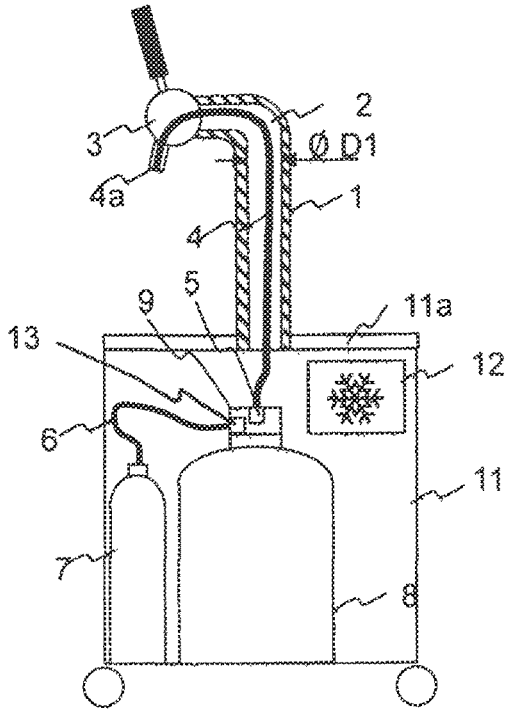
FIG. 1: shows one embodiment of a roving dispensing unit according to the present invention.

As illustrated in FIG. 1, the present invention concerns a roving beverage dispensing unit for dispensing a beverage at temporary events reproducing the dispensing conditions encountered in a public house. Such units are particularly suitable for dispensing beer and beer-like beverages (i.e., comprising malt), cider, and any other ready to dispense beverages. The dispensing units of the present invention distinguish themselves from soda dispensers wherein a source of carbonated water is mixed with a concentrated syrupy composition prior to flowing out of a tap. The use of a pump for pumping the beverage out to the outlet of the dispensing tube, as described e.g., in U.S. Pat. No. 6,832,487, is not envisaged as it makes a noise not to be associated with the serving conditions encountered in a public house, and in particular, driving beer through a pump is not compatible with the foam forming conditions required in a beer or beer-like beverage. The dispensing of beverage is driven by the higher pressure reigning in the container compared with ambient. The high pressure in the container is achieved by bringing a source of pressurized gas (7) in fluid communication with the interior of the container (8) by a pressure tube (6). The source of pressurized gas (7) can be a pressurized bottle or cartridge, a connection to the net or a compressor. In the latter case, the beverage never contacts any element of the pump. This is used solely for increasing the pressure inside the container. In special kegs, containing an adsorbent carrier such as a zeolite or carbon black, it is possible to store the pressurizing gas in the container itself, adsorbed on said solid carrier as described, e.g., in WO02/014210, U.S. Pat. No. 4,049,158, WO2009/142977, U.S. Pat. No. 3,096,000; WO2006/086932, WO2008/014210, and EP application number EP11162787.

The container (8) which can be a standard metal keg or any container as revised in the Background Art section can be loaded inside a compartment or chamber (11) comprising refrigerating means (12) for cooling the interior of the compartment (11). The exact type and disposition of the cooling means are not critical to the present invention, and any known refrigerating system available on the market can be implemented in the present dispensing unit depending on their respective performance. If a compressor or a pressurized bottle is used as source of pressurized gas, these can be accommodated inside the chamber (11). For sake of economy, however, the source of pressurized gas (7) can be thermally separated from the refrigerating means (12).

On top of the compartment (11) an elongated tapping tower or column (1) is fixed. The tapping column (1) could also be fixed to a side wall of compartment (11), but it would add an additional curve to the column which is not necessarily advantageous in terms of ease of introducing a dispensing line. The tapping tower (11) comprises an elongated inner channel (2) extending between a first, bottom end, fixed to the compartment (11) to the second, opposite, top end of the tapping column. The opening at the first bottom end of the tapping column is in fluid communication with the interior of the cooled compartment through an aperture at the top surface (11*a*) thereof as illustrated in FIG. 1. A tapping valve element is provided within the channel at a location adjacent to the second, top end of the tapping tower (1). The inner channel (2) of the tapping tower has a smallest diameter, D1. In case of a circular channel, the smallest diameter, D1, is the diameter of the channel. For non circular channels, the smallest diameter is the smallest of the diameters passing by the centroid of all cross-sections normal to the longitudinal axis of the channel.

Finally, the dispensing unit of the present invention comprises a dispensing tube (4) which must be at least partially flexible and comprising a first, inlet end and a second, outlet end (4*a*). The dispensing tube (4) must be at least partially flexible in that, it must be suitable for following any curve of the inner channel (2) of the tapping column (1). In a preferred embodiment, the valve element (3) of the tapping column is a pinch valve. In this embodiment, the outlet end (4*a*) of the dispensing line is to be engaged into the pinch valve (3) of the tapping column, and must be flexible enough to be squeezed or released by the pinch valve in order to control the flow of liquid therethrough. For these reasons, the largest dimension of the dispensing tube (4) and the connecting means connector (5) must be smaller than the smallest diameter, D1, of the inner channel (2) of the tapping column.

Figure 4A:
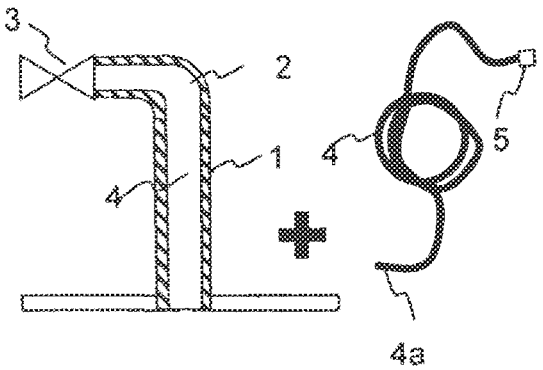
FIGS. 4A, 4B, and 4C: show (a) a first and (b) second embodiments for obtaining (c) a tapping valve suitable for controlling the liquid flow through a dispensing line.

It is a mandatory requirement, for hygienic reasons, that all the parts of the unit being in contact with the liquid to be dispensed be disposable and changed with each new container loaded in the unit. This requirement applies in particular to the tapping valve. The use of a pinch valve (3) positioned at the top end of the tapping column is particularly preferred because it is a cheap, hygienic and reliable valve system, requiring only that the outlet portion (4*a*) of the dispensing line be flexible to collaborate with the pinch valve. The liquid never contacts the pinch valve which presses between jaws the exterior of the dispensing line. This embodiment is schematically represented in FIG. 4A, wherein the pinch valve (3) is mounted at the top end of the tapping column, and the outlet portion (4*a*) of the dispensing line is a simple, flexible tubular portion, very cheap to manufacture. The outlet portion (4*a*) of the dispensing tube is simply engaged between the jaws of the pinch valve held in open position, to bring the tapping unit in tapping configuration (cf. FIG. 4C).

Figure 4B:
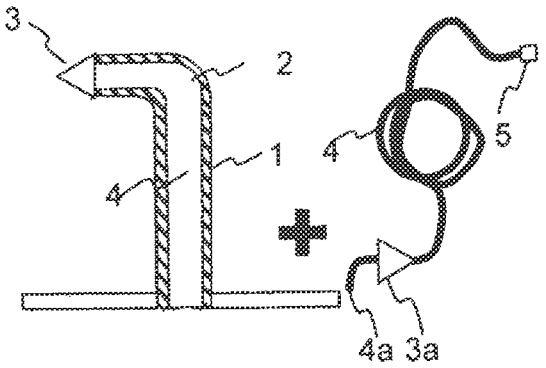
Figure 4C:
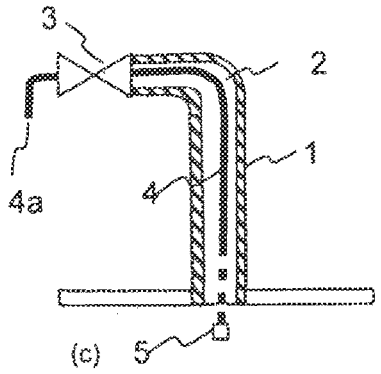

In an alternative embodiment, represented schematically in FIG. 4B, the tapping valve is composed of a first valve element (3) mounted at the top end of the tapping column and of a second, valve co-element (3*a*), mounted at the outlet portion (4*a*) of the dispensing line, and required to be coupled with the first valve element (3) to bring the tapping valve in tapping configuration illustrated in FIG. 4C. This embodiment is more expensive than a pinch valve discussed above, since the dispensing line must be provided with a second valve co-element (3*a*), but it may be advantageous, for example, in providing a fool proof safety feature, preventing any liquid from flowing out of the container until the dispensing line (4) is fully connected to the container, at its inlet end, and to the tapping valve at its outlet end, and the tapping valve actuated. With a pinch valve, the user must first open the jaws of the pinch valve to insert the dispensing tube, and must necessarily close the valve (i.e., pinch the flexible portion of the dispensing line), before connecting the inlet end to the container. If the pinch valve is not closed upon connecting the line to the container, liquid may accidentally flow out. This problem could be avoided with a valve co-element (3*a*) mounted at the outlet portion of the dispensing line.

The first inlet end of the dispensing tube is provided with connecting means (5) suitable for connecting said inlet end to the container thus bringing the liquid contained in the container in fluid communication with the outlet end of the dispensing line. In a preferred embodiment, the connecting means (5) provide a releasable coupling to the container, such as by means of a bayonet, a threaded nut, a pin, preferably with a safety feature like a ring provided at one end thereof, and the like. In an alternative embodiment, the coupling obtained with the connecting means (5) to the container is permanent, such as with a resilient snap-fit. This solution offers the same advantage as the dispensing tube permanently connected to a container disclosed in US2004/0226967, in that when a keg is empty it cannot be removed without removing at the same time the dispensing line (4), so that a new dispensing line (4) must necessarily be mounted with the next keg, which ensures the hygienic conditions of the unit. By contrast with a dispensing tube permanently attached to the keg, the present invention using a snap-fit connecting means allows a "top-down" insertion of the dispensing tube.

The main advantage of the dispensing units according to the present invention is that the dispensing tube (4) can be introduced from the top of the tapping column (1) through the inner channel (2) all the way down to the cooled compartment (11) where the inlet of the dispensing tube can be coupled to the container by means of the connecting means (5). This "top-down" insertion mode of the dispensing tube is substantially more comfortable than the traditional "bottom-up" insertion mode used in all the roving dispensing units of this type disclosed to date. This was confirmed by a test panel of 10 users, asked to load a new keg with bottom-up insertion of the dispensing line in a dispensing unit according to US2004/0226967 and with top-down insertion of the dispensing line according to the present invention. The opinions were unanimously in favour of the latter. The complete installation of a new keg with connection of the dispensing tube to the keg and tapping valve was also substantially shorter with the top-down insertion mode proposed in the present invention.

Figure 2:
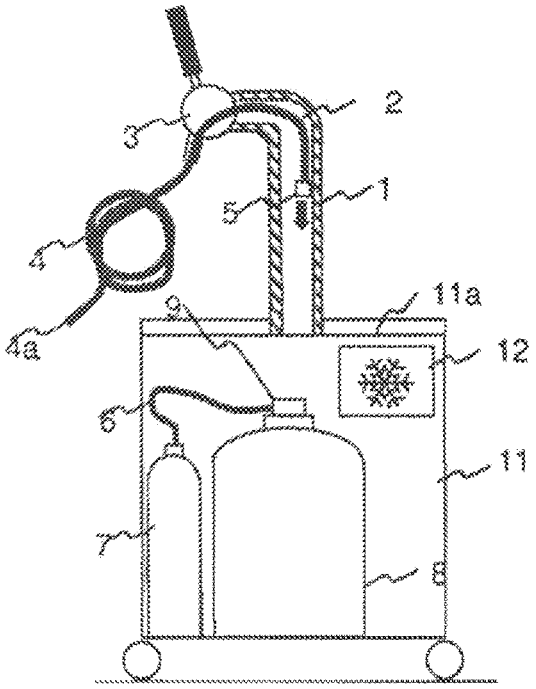
FIG. 2: shows a first embodiment of how to install a new dispensing tube into the unit of FIG. 1.
Figure 3A:
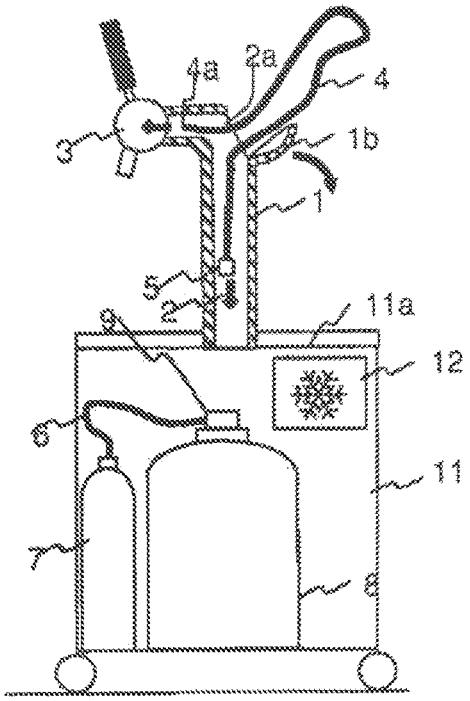
FIG. 3A: shows a second embodiment of how to install a new dispensing tube into the unit of FIG. 1.
Figure 3B:
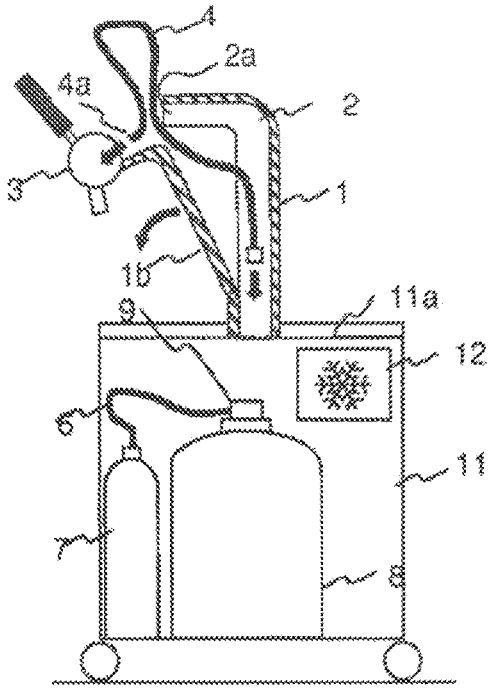
FIG. 3B: shows a third embodiment of how to install a new dispensing tube into the unit of FIG. 1.
Figure 3C:
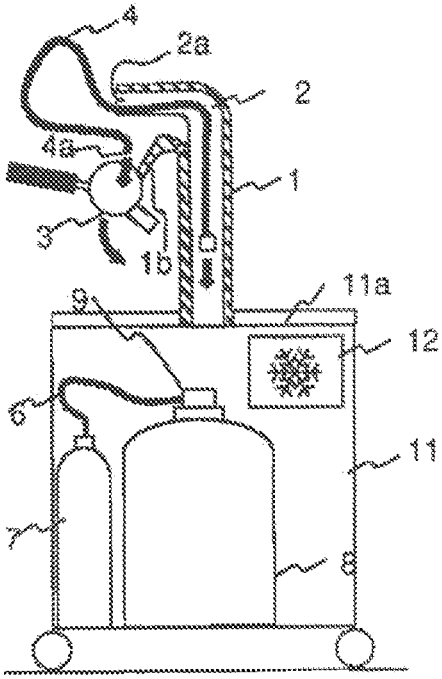
FIG. 3C: shows a fourth embodiment of how to install a new dispensing tube into the unit of FIG. 1.

In a top-down insertion mode as proposed in the present invention, the inlet end of the dispensing tube, including the connecting means (5) can be introduced from the outlet of the channel (2) of the tapping tower (1) as illustrated in FIG. 2, engaged into the valve element (3) which must be held in open position, and driven all the way down into the compartment, where it is then connected to the container (8). In an alternative embodiment illustrated in FIG. 3A to 3C, the channel (2) comprises an opening (2*a*) located upstream from the pinch-valve, whence the inlet end of the dispensing line, including the connecting means (5), can be driven through the channel (2) down into the compartment (11). The outlet end of the dispensing tube can be introduced into the valve element from upstream, wherein upstream and downstream refer herein to the dispensing direction of flow of the beverage. In case of a pinch valve (3), to ensure that the tapping valve (3) is closed prior to coupling the connecting means (5) of the dispensing tube to the container, a safety feature can prevent the opening (2*a*) of the tapping tower to be closed unless the pinch valve (3) is closed. In FIG. 3A, the channel opening (2*a*) is located at the elbow of the tapping column and is closed by a moving lid (1*b*). In another embodiment illustrated in FIG. 3B, a whole section of the tower can be opened, as described, e.g., in EP1982952. In a third embodiment illustrated in FIG. 3C, the valve head (3) only can be opened, giving a free access to the channel upstream from the valve.

In traditional kegs, the dispensing line (4) and pressure line (6) are connected to the container by means of a connecting device (9), fixed to the mouth of the container and suitable for bringing in fluid communication corresponding portions of the interior of the container with the dispensing line (4) and pressure line (6), respectively. This traditional approach can still be used with a unit according to the present invention, but the receiving portion of this connecting device, for receiving the connecting means (5) of the dispensing tube (4) must be adapted to receive a smaller connecting means (5) than traditionally used, an example of which is illustrated in FIG. 2 of WO2009/115928. Indeed, traditionally used connecting means are too large to be run through the inner channel of the tapping column of a roving dispensing unit. In an alternative embodiment, the dispensing tube (4) and the pressure line (6) are connected directly to the closure of the container comprising corresponding openings. This further simplifies the loading of a new keg in the unit.

A new keg can be loaded into a dispensing unit according to the present invention and the dispensing unit brought into operational conditions with the following steps.

(a) Providing a new beverage container (8) of any type suitable for dispensing the content thereof by pressurizing the interior of the container as discussed in the introductory section; the container can be loaded into the cooled compartment or left to stand outside next to it, as preferred by the user;

(b) engaging a portion of the inlet end (4*a*) into the valve element (3) and Introducing the inlet of the dispensing tube, including the connecting means (5), into the channel (2) of the elongated tower (1) and driving it down into the engaging a portion of the outlet end (4*a*) into the valve element (3) and Introducing the inlet of the dispensing tube, including the connecting means (5), into the channel (2) of the elongated tower (1) and driving it down into the compartment (ii), where it may hang loose from the inlet of the inner channel whence the connecting means (5) can easily be held by hand and;

(c) Connecting the connecting means (5) of the dispensing line (4) to the container (8);

(d) Connecting a source of pressurized gas (7) with the interior of the container via a pressure line (6). In case of a pinch valve and if the dispensing line (4) does not comprise a stop-valve, which presence is not mandatory in the present invention contrary to prior art units, the pinch valve (3) must be closed before the interior of the container is brought into fluid communication with both pressurized gas source (7) and dispensing line (4).

(e) if the container is still standing outside the compartment (11), loading the container into the cooled compartment (11) and closing the door of the compartment.

The beverage contained in the container must be left to cool in the cooled compartment until it reaches the desired temperature, at which point it can be dispensed and consumed.

The roving dispensing unit illustrated in the appended Figures is represented with wheels which facilitate the displacement of the unit from one point to the other. The compartment (11) may be sufficiently large for storing one or more additional kegs beside the one being connected to the dispensing and pressure tubes (4)&(6), so that they are at or close to the desired serving temperature at the time of replacing a spent container, thus allowing quasi-continuous use of the dispensing unit. The quasi-continuity of use of the unit is further enhanced by the top-down insertion mode of the dispensing tube (4) through the inner channel (2) of the tapping tower (1) which allows loading of a new keg at a much higher rate than allowed with the bottom-up restricted units of the prior art.

The invention claimed is:

1. A roving beverage dispensing device, comprising:

(a) a beverage container containing a liquid beverage to be dispensed;

(b) an at least partially flexible beverage dispensing line comprising an inlet end and an outlet end, the inlet end being provided with a dispensing line connector configured to connect said inlet end to said container to provide fluid communication between the container and the outlet end of the dispensing line;

(c) a pressure line, the pressure line comprising an outlet releasably connectable to the container and providing fluid communication between an interior of the container and a source of pressurized gas;

(d) a compartment for containing said container and comprising a refrigeration device;

(e) an elongated tapping column comprising a fixed end fixed to the top surface of the compartment and comprising an elongated inner channel, said elongated inner channel having a smallest diameter (D1), and providing fluid communication between the interior of the compartment and a tapping valve element located at or adjacent to the top end of the elongated tapping column, said tapping valve element configured to receive a portion of the outlet end of the dispensing line and controls the flow of liquid therethrough, wherein the largest diameters of the dispensing line and the dispensing line connector are both smaller than a smallest diameter (D1) of the elongated inner channel and the tapping valve element such that the dispensing line and dispensing line connector can be introduced from the top end of the elongated tapping column, through the tapping valve element held in an open position, down through the channel and into the compartment where it can be connected to the container.

2. The dispensing device according to claim 1, wherein the dispensing line connector is selected from a bayonet, a threaded nut, a pin, and a resilient snap-fit.

3. The dispensing device according to claim 1, wherein the valve element is a pinch valve and a portion of the outlet end of the dispensing line to be engaged in said pinch valve is flexible.

4. The dispensing device according to claim 1, wherein the valve is made of two elements:

a first valve element mounted on the column; and a second, co-element mounted at the outlet portion of the dispensing line and suitable, when engaged therein, for collaborating with the first valve element to control the flow of liquid through the dispensing line.

5. The dispensing device according to the claim 1, wherein the beverage to be dispensed and contained in the container is beer, carbonated malt beverages or cider.

6. The dispensing device according to claim 1, wherein the source of pressurized gas is a pressurized gas bottle located within the compartment.

7. A method for loading a new beverage container into a roving dispensing device as defined in claim 1, comprising the following steps:

(a) providing a new container;

(b) engaging a portion of the outlet end into the valve element and introducing the inlet of the dispensing line, including the dispensing line connector, into the channel of the elongated tower and driving down into the compartment and:

(c) connecting the dispensing line connector to the container; and (d) connecting a source of pressurized gas with the interior of a new container via a pressure line with a pressure line connector.

8. The method according to claim 7, wherein the inlet end of the dispensing line, including the dispensing line connector is introduced from the outlet of the channel of the tapping tower, engaged into the valve element, and driven all the way down into the compartment where it is then connected to the container.

9. The method according to the claim 7, wherein the channel comprises an opening located upstream from the valve element, whence the inlet end of the dispensing line, including the dispensing line connector is driven through the channel down into the compartment, and the outlet end of the dispensing line is introduced into the pinch-valve from upstream.

10. The method according to claim 7, wherein the valve element is either:

(a) a pinch valve and a portion of the outlet end of the dispensing line to be engaged in said pinch valve is flexible; or (b) a first element of a valve made of two elements said first element being mounted on the column and suitable for collaborating with a second, co-element mounted at the outlet portion of the dispensing line and, when the latter is engaged in the first element to control the flow of liquid through the dispensing line.

11. The method according to claim 7, wherein the valve element shall be closed prior to connecting the dispensing line to the container.

12. The dispensing device according to claim 1, wherein both the connectors of the dispensing line and the pressure line are connectable to the container through a receiving portion of a connecting device, fixed to the mouth of the container and suitable for bringing in fluid communication corresponding portions of the interior of the container with the dispensing line and pressure line, respectively.

* * * * *